United States Patent [19]

Capasso

[11] Patent Number: 4,881,657

[45] Date of Patent: Nov. 21, 1989

[54] MILITARY GAS CAN VENT CAP

[76] Inventor: Gary L. Capasso, 6121 Collins Rd., #251, Jacksonville, Fla. 32244

[21] Appl. No.: 230,524

[22] Filed: Aug. 10, 1988

[51] Int. Cl.[4] ..... B65D 51/16

[52] U.S. Cl. ..... 220/303; 220/371; 220/373; 220/DIG. 33

[58] Field of Search ..... 220/303, 367, 371, 373, 220/DIG. 33

[56] References Cited

U.S. PATENT DOCUMENTS

| | | | |
|---|---|---|---|
| 1,453,299 | 5/1923 | Wetzel | 220/303 |
| 2,298,938 | 10/1942 | Griffin, Jr. et al. | 220/373 |
| 2,723,060 | 11/1955 | Rieke | 222/566 |
| 3,385,468 | 5/1968 | Fleming et al. | 220/371 |
| 3,927,798 | 12/1975 | Loomis | 220/373 X |
| 4,022,344 | 5/1977 | Roamer | 220/855 P |
| 4,265,752 | 5/1981 | O'Banion | 220/86 R |
| 4,572,386 | 2/1986 | Marcus | 220/855 P |
| 4,640,446 | 2/1987 | Walker | 220/855 P |

FOREIGN PATENT DOCUMENTS

| | | | |
|---|---|---|---|
| 1075630 | 7/1967 | United Kingdom | 220/373 |

*Primary Examiner*—Stephen Marcus
*Assistant Examiner*—Nova Stucker
*Attorney, Agent, or Firm*—Leon Gilden

[57] ABSTRACT

A military gas can vent cap is set forth wherein a step-adapter sleeve is threadedly insertable within an existing military gasoline-type can. An upwardly projecting portion of the adapter sleeve is of a diameter greater than the lower portion to provide a planar surface for interfittingly imposing pressure onto a resilient gasket positioned within an interior portion of an associated cap. The cap is provided in a first embodiment with a vent hole directed into a tubular vent portion positioned on an upper surface of the cap filled with porous brass stock material to enable venting of fumes from interiorly of the can and preventing water intrusion from the interior of the can. A second embodiment includes a porous brass positioning member securing the gasket to the interior surface of the cap to enhance movement of fumes therethrough and to the vent.

3 Claims, 1 Drawing Sheet

MILITARY GAS CAN VENT CAP

BACKGROUND OF THE INVENTION

1. Field of the Invention

The field of invention relates to caps, and more particularly pertains to a new and improved military gas can vent cap and adapted for sealingly maintaining the integrity of the contents within a conventional military-type gas can.

2. Description of the Prior Art

Gasoline cans, and particularly military-type gasoline cans of the prior art, have allowed the intrusion of water interiorly thereof by the practice of loosely securing the cap associated with such cans onto the can body enabling water intrusion downwardly along the threads of the cap and spout and past a conventional gasket associated with such caps. While various closures in the prior art have attempted to provide sealing means and sealing means with vents therethrough, they have yet failed to provide the desired combination of providing sealing and venting of a gasoline container as typically utilized in the military-type gas can configuration employing a relatively large diameter threaded opening for the entering and discharge of gasoline therefrom.

Examples of prior art caps include U.S. Pat. No. 2,723,060 to Rieke wherein a pouring spout is secured to a neck by means of a clamping ring radially compressing the spout to the ring by suitable compressing tools with an overfitting closure to seal contents therein to typify generally the resealably type pouring spout, as utilized in the prior art.

In U.S. Pat. No. 4,022,344 to Roamer sets forth a pouring spout depending upwardly from within a container formed with a plurality of annularly threaded members to provide pouring spouts of varying diameters, but wherein the spouts utilize conventional threaded caps and are subject to leakage by the loose or ill-positioned application of a gasket associated with a cap.

U.S. Pat. No. 4,265,752 to O'Banion sets forth a closure for use particularly on a vehicular gas tank wherein a vent groove is formed with a passage extending through an upper and lower end of an associated closure with the vent groove including a first end communicating with the passage through the closure body and a second end communicating with the periphery of the closure body. The patent essentially provides a complex detailed construction including a gasket relying on differential pressure and the like to provide for the vent cap organization and is accordingly of a remote structure relative to the simple but effective vent cap closure system set forth by the instant invention.

U.S. Pat. No. 4,572,386 to Marcus includes a pyramidal type pouring spout threadedly securable to an outlet of an existing container with a cap secured thereon wherein the spout may be utilized as a funnel or as a pouring spout, as desired.

U.S. Pat. No. 4,640,446 to Walker sets forth a gas container including first and second removable fuel outlets or tubes nestable within each other during storage wherein one of the tubes is utilized as a pour spout while the other tube constitutes a fuel line coupling member. The patent is of interest relative to the configuration of pouring spouts, but is remote from the instant invention in essence and application.

As may be appreciated therefore, there continues to exist a need for a new and improved military gas can vent cap that includes the aspects of effectiveness and simplicity of construction, and in this respect, the present invention substantially fulfills this need.

SUMMARY OF THE INVENTION

In view of the foregoing disadvantages inherent in the known types of vent caps now present in the prior art, the present invention provides a military gas can vent cap wherein the same effectively and efficiently prevents contamination of the contents of a military-type gas can by utilization of porous brass material positioned at a terminal end of a vent extending interiorly of an associated gas cap. As such, the general purpose of the present invention, which will be described subsequently in greater detail, is to provide a new and improved military gas can vent cap which has all the advantages of the prior art vent caps and none of the disadvantages.

To attain this, the present invention includes a stepped adapter ring to provide a planar engagement surface for contact in combination with a resilient type gasket positioned interiorly of a cap wherein the gasket includes a positioning plug to maintain the gasket at a predetermined distance from interior surface of the cap to enable passage of fumes between the gasket and interior cap surface through an outlet vent. Additionally, a porous brass member may be utilized to position and stake the gasket in position and enable passage of fumes therethrough.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of technical disclosure of the application. The abstract is neither intended to define the invention of the application, which is measured by the claims, nor is it intended to be limiting as to the scope of the invention in any way.

It is therefore an object of the present invention to provide a new and improved military gas can vent cap which has all the advantages of the prior art military gas can vent caps and none of the disadvantages.

It is another object of the present invention to provide a new and improved military gas can vent cap which may be easily and efficiently manufactured and marketed.

It is a further object of the present invention to provide a new and improved military gas can vent cap which is of a durable and reliable construction.

An even further object of the present invention is to provide a new and improved military gas can vent cap which is susceptible of a low cost of manufacture with regard to both materials and labor, and which accordingly is then susceptible of low prices of sale to the consuming public, thereby making such military gas can vent caps economically available to the buying public.

Still yet another object of the present invention is to provide a new and improved military gas can vent cap which provides in the apparatuses and methods of the prior art some of the advantages thereof, while simultaneously overcoming some of the disadvantages normally associated therewith.

Still another object of the present invention is to provide a new and improved military gas can vent cap wherein an adapter ring provides a planar engagement surface for securement of a gasket interiorly of a gas cap.

Yet another object of the present invention is to provide a new and improved military gas can vent cap wherein venting is provided through porous brass stock to prevent contamination of contents within an associated storage container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
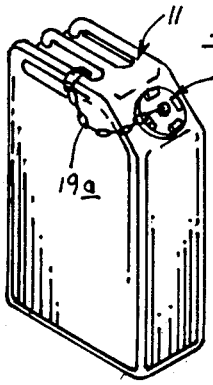
FIG. 1 is an isometric illustration of the instant invention in association with a conventional military-type gas can.

With reference now to the drawings, and in particular to FIGS. 1 to 4 thereof, a new and improved military gas can vent cap embodying the principles and concepts of the present invention and generally designated by the reference numeral 10 will be described.

Figure 2:
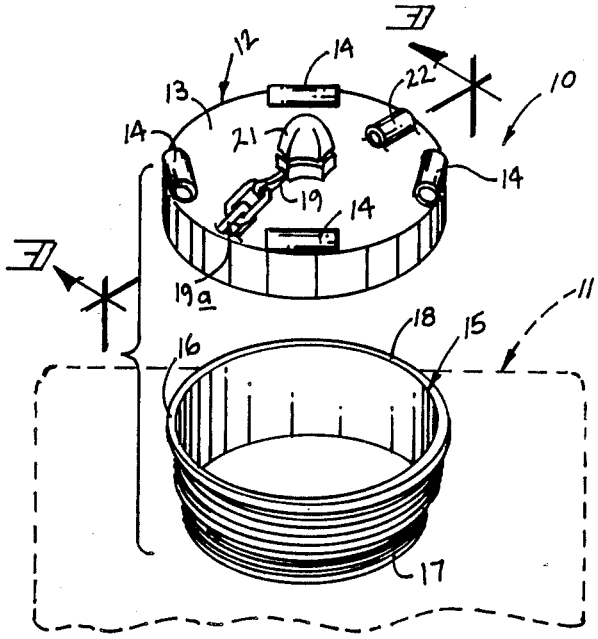
FIG. 2 is an expanded isometric illustration of the instant invention.
Figure 3:
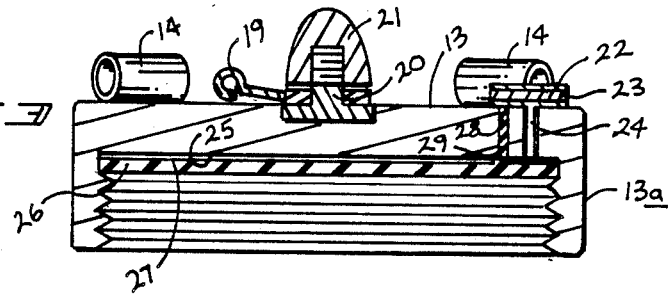
FIG. 3 is an orthographic cross-sectional view taken along the lines 3—3 of FIG. 2 in the direction indicated by the arrows.
Figure 4:
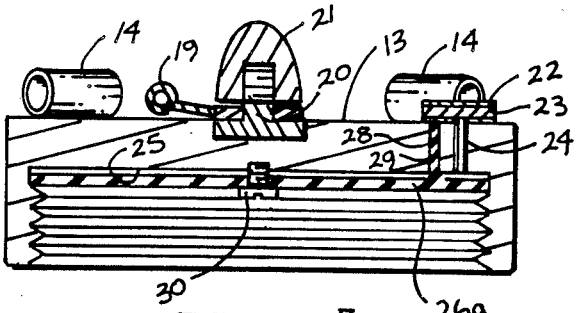
FIG. 4 is an orthographic view a modified cap, as set forth in FIG. 3.

More specifically, it will be noted that the military gas can vent cap apparatus 10 is illustrated as assembled to an associated military gas can 11 in FIG. 1. FIG. 2 illustrates the military gas can formed with a cap 12 including a downwardly extending circumferential flange 13*a*. Positioned about the perimeter of the top surface 13 are a series of lugs 14 of conventional orientation for enabling grasping of the cap 12 for manipulation. The cap 12 is utilized in conjunction with an annular stepped adapter 15 for threadedly interfitting with the military gas can 11 wherein the second diameter lower externally threaded portion 17 is threadedly interfitted to the military gas can whereby an upper first diameter externally threaded portion 16 threadedly accepts the internal threads of the cap 12. It is desirable when the adapter 15 is positioned within the gas can 11, that an adhesive be utilized onto the threads of the second diameter portion 17 to maintain a leak-proof seal therebetween. The adapter is finally formed with a planar upper terminal surface 18 to sealingly engage the interior gasket positioned within the cap 12, as illustrated in FIGS. 3 and 4. A chain connector 19 is formed with a first end for securement to a connecting chain 19*a* and a second end formed with an annular ring rotatably mounted on a upwardly extended threaded boss 20 which accepts an internally threaded conical cap 21 for prevention of loss of the cap 12.

A vent tube 22 is integrally formed onto the top surface 13 of the cap 12 where the vent tube contains a porous brass material 23 (or any other suitable non-corrosive material) positioned therein with a vent conduit 24 extending from interiorly of the cavity defined by cap 12 to interiorly of the vent tube 22 to provide a conduit or channel for escape of gases and vapor developed within the associated can 11 whereby liquid contamination of the contents of can 11 is prevented from entering the can 11 by means of the porous brass stock material 23 preventing such intrusion.

The vent conduit 24 extends through the upper interior surface 25 of the cap 12 into a space 27 defined between the upper interior surface 25 and the resilient gasket 26. Accordingly, the space 27 provides a path through which vapors may travel that are trapped within the gas can 11. To maintain the positioning of the gasket 27 at a space removed from the interior surface 25 of the cap 12, an upwardly extending integrally formed stem 28 associated with the gasket 26 extends into a bore 29 adjacent the vent conduit 24 to maintain the spacing 27, as defined earlier.

Reference to FIG. 4 illustrates a modification where a porous brass fixing member 30 extends through the gasket 26, through the space 27 of the cap 12 threadedly secured thereto, and enables vapors to travel through the fixing member 30 into the space 27 and outwardly of the can by means of the vent conduit 24.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vent cap apparatus for use in combination with a container, and container formed with an internally threaded opening, said apparatus comprising, an adapter means for threadedly interfitting with said internally threaded opening at a lower end of said adapter and accepting an internally threaded cap at an upper end of said adapter, and said cap including an exterior upper surface with a vent tube integrally secured thereto for permitting passage of vapor from within said container and prevent liquid intrusion from entering said container, and a vent conduit operatively connected from a first cavity interiorly of said vent tube to a second cavity defined between an annular gasket positioned interiorly of said cap and an upper interior surface of said cap, and wherein said adapter means comprises an externally threaded annular conduit wherein said lower end is of a first diameter and said upper end is of a second diameter and said upper end is of a diameter greater than said first diameter, and said adapter is formed with an upper terminal planar surface means for engagement with an outer perimeter of said gasket and wherein said vent conduit includes a porous non-corrosive material secured therein for enabling passage of vapors and preventing passage of liquid therethrough, and wherein said gasket includes a stem positioned within a bore adjacent said vent conduit for maintaining said gasket at a desired orientation relative to said upper interior surface to define said second cavity.

2. A vent cap apparatus as set forth in claim 1 wherein a porous fixing member extends through said gasket to said upper interior of said cap to enable passage of vapor through said gasket to said second cavity.

3. A vent cap apparatus as set forth in claim 2 wherein an upwardly threaded boss extends orthogonally relative to said exterior upper surface and accepts a ring rotatably mounted thereon, said ring includes a further end for securement of a chain thereto on said chain is secured to said container at its other end for prevent loss of said cap.

* * * * *